United States Patent [19]

Wassen

[11] 4,217,770

[45] Aug. 19, 1980

[54] DRAWING HOLLOW BLANKS IN MULTIPLE STEPS

[75] Inventor: Johannes Wassen, Bielefeld, Fed. Rep. of Germany

[73] Assignee: Mannesmann Aktiengesellschaft, Düsseldorf, Fed. Rep. of Germany

[21] Appl. No.: 941,082

[22] Filed: Sep. 11, 1978

[30] Foreign Application Priority Data

Aug. 24, 1977 [DE] Fed. Rep. of Germany ..... 2738559

[51] Int. Cl.[2] ..... B21D 22/28

[52] U.S. Cl. ..... 72/349

[58] Field of Search ..... 72/349, 42, 347, 348

[56] References Cited

U.S. PATENT DOCUMENTS

| | | | |
|---|---|---|---|
| 2,412,813 | 12/1946 | Keller | 72/349 |
| 3,509,754 | 5/1970 | Messingill et al. | 72/349 |
| 3,774,426 | 11/1973 | Jeyik | 72/349 |
| 3,848,449 | 11/1974 | Campion | 72/349 |
| 3,972,217 | 8/1976 | Misonoo | 72/349 X |

*Primary Examiner*—Leon Gilden

*Attorney, Agent, or Firm*—Smyth, Pavitt, Siegemund, Jones & Martella

[57] ABSTRACT

Plural dies for stepwise drawing a hollow blank on a mandrel are spaced so that a downstream die is placed at a location where the drawing strain from the previous die has been reduced to zero because the tensile stress in the deforming zone is balanced by adhesion to the mandrel.

2 Claims, 1 Drawing Figure

I
II
III
1
2
H
H1
H2
HL1
HL2
L
s1
s2
s3
s4
ρ
o

DRAWING HOLLOW BLANKS IN MULTIPLE STEPS

BACKGROUND OF THE INVENTION

The present invention relates to drawing tubes or pipes, and more particularly, the invention relates to drawing hollows in several stages or steps while supporting the hollow from the inside.

It is known generally to draw tubes or pipes by means of an annular die while supporting the tube or pipe on an inserted mandrel. The hollow blank is drawn and stretched in this fashion onto and over the mandrel. However, the deformability (ductility) of the hollow blank is limited on account of its structural properties. For larger degrees of deforming and working one has to draw the blank in sequential steps. The known equipment is quite extensive and the working time is multiplied. The same drawbacks can be observed upon inside drawing the blank. The known multiple drawing techniques in particular involve annealing, repickling and bonderizing the partially blank drawn between drawing steps; also new bottle-necking has to be provided for.

DESCRIPTION OF THE INVENTION

It is an object of the present invention to provide new and improved method and system for stepwise drawing a hollow using external drawing dies and internal support.

It is a specific object of the present invention to provide a new and improved method and system for drawing hollows which permit up to three or even four fold a deformation than heretofore possible without changing the mandrel.

In accordance with the preferred embodiment of the present invention, it is suggested to space sequential drawing steps on the same mandrel as supporting the hollow blank so that the resulting tensile stress on account of drawing by one die balances completely the adhesive force as between the mandrel and the blank downstream from the die before subjecting the blank to drawing by another die downstream from the first mentioned die. The same arrangement is repeated as often as desired.

The invention makes particularly use of the fact that the drawing strain as exerted upon the hollow is reduced to zero before the next drawing die becomes effective, which means that each die can apply maximum deformation and drawing strain. The invention is used with particular advantage for drawing heavy wall pipes in sequential steps using the same mandrel which reduces overall inventory. Avoiding multiple, basically independent single drawing steps, avoids the otherwise necessary inbetween steps such as annealing, severing the bottleneck dressing, pickling, bonderizing, lubricating, making a new bottleneck, etc., including all supplemental steps such as temporary storage, maintenance, process and equipment supervision etc.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows a hollow blank 1 whose undeformed state and condition can be seen in the left-most portion of the figure; the blanks wall thickness S1 is a substantial one. Numeral I denotes an annular die which constitutes the first drawing stage, forcing and pressing the hollow blank against the mandrel or mandrel rod 2, to reduce the diameter of the hollow as well as its wall thickness to a value S2. The reduced blank is urged against the mandrel or rod 2 resulting in an adhesion H.

Figures 1, 2:
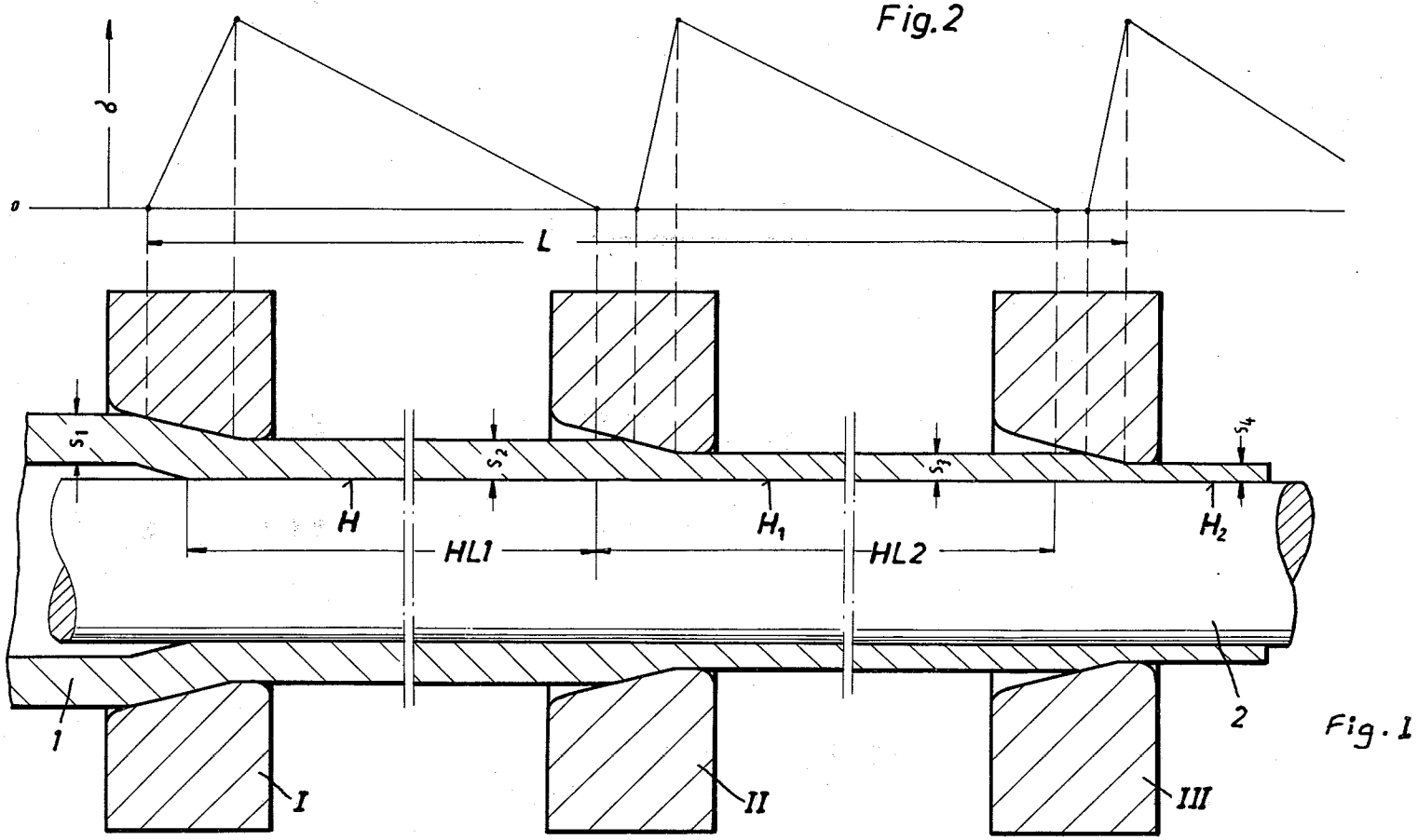
FIG. 1 is a cross-section through a three stage drawing system for working a hollow shown in alignment with a diagram in which tension in one.

The second stage II includes also an annular drawing die which does modify the inner diameter but reduces the wall thickness of the blank to S3 and a final stage III reduces the thickness to S4. Downstream from these stages, there is adhesion H1 and H2, respectively. The drawing stages and dies are spaced by distances HL1 and HL2, respectively, defining the spacing of a die from the respective next one upstream. These spacings have been selected as follows.

The diagram in the upper part of FIG. 1 depicts a zero line and shows drawing strain plotted as distributed along the axis of the hollow, which is the axis of drawing. Reference character L denotes the total length of actual drawing in this three stage system. Each stage produces a maximum drawing strain in the blank, being peak value $\delta$ from which the drawing strain drops down and reaches to zero right in front of a location upstream of the respective next stage. The drawing tension and strain provided by the drawing dies and is reacted gradually into the inner support, via the adhesion, so that indeed the strain is reduced to zero at a location downstream from a drawing die. The next drawing step is applied downstream from but quite close to that point in each instance. The newly provided drawing strain is again reacted into the mandrel rod etc. This sequence can be repeated as frequently as is desired. Decisive is that the drawing strain be reduced to zero through reaction into the rod before the next drawing step is applied, which means that the tensile stress as set up in the blank by the blank is balanced by the resulting adhesion downstream. Start up of drawing including bottlenecking and lubrication is carried out conventionally, but is required only once.

The advantage of the inventive method will become more apparent by comparing it with the prior art method. It may be assumed that a hollo blank (steel) having a diameter of 44.5 mm and a wall thickness of 2.6 mm, is to be reduced to a diameter of 31 mm at a wall thickness of 0.75 mm, and by conventional sequence of drawing steps. After pickling and bonderizing the blank a bottleneck is formed and the blank is drawn twice. The reduced tubes are separated, annealed, pickeled, bonderized, provided with a bottleneck, drawn again etc., while one obtained the final dimensions.

In accordance with the invention, a hollow blank of, for example 51 mm diameter and 3.6 mm wall thickness is drawn in six sequential drawing stages as described, and down to similar final dimensions, but in a single continuous process. This continuous process reduces equipment expenses as well as working time, because one does not use multiple, separated drawing devices nor is intermediate annealing, pickling, bonderizing, bottlenecking, etc., necessary. Also, the yield is higher due to reduced waste.

The invention is not limited to the embodiments described above but all changes and modifications thereof not constituting departures from the spirit and scope of the invention are intended to be included.

I claim:

1. Method of drawing hollow blanks comprising:

passing the hollow blank through a plurality of drawing dies for stretch-drawing the hollow blank in sequential reducing steps and onto a mandrel; and spacing the drawing dies so that the resulting tensile stress in the hollow blank downstream from a die balances the adhesion to the mandrel ahead of the respective next reducing die as both said dies engage the hollow on the mandrel concurrently.

2. Method of drawing hollow blanks comprising:

pulling the hollow blank on a mandrel through a first drawing die; and pulling the same hollow blank on the same mandrel through a second drawing die, being spaced from the first drawing die, still engaging the hollow blank, at a location downstream from zones in the hollow blank, in which the effective drawing strain has been reduced to zero so that the tensile stress in the just deformed zone is balanced by adhesion of the hollow blank to the mandrel between the two dies.

* * * * *